United States Patent [19]

Beckett

[11] Patent Number: 4,517,784

[45] Date of Patent: May 21, 1985

[54] PROGRAMMABLE CASE SEALING MACHINE

[75] Inventor: Joel M. Beckett, Eatonville, Wash.

[73] Assignee: Marq Packaging Systems, Inc., Yakima, Wash.

[21] Appl. No.: 388,655

[22] Filed: Jun. 15, 1982

[51] Int. Cl.[3] ..... B65B 57/02

[52] U.S. Cl. ..... 53/75; 53/69; 493/1; 493/21; 493/35

[58] Field of Search ..... 53/69, 67, 76, 75; 493/30, 21, 23, 35, 1, 2

[56] References Cited

U.S. PATENT DOCUMENTS

| | | | |
|---|---|---|---|
| 3,364,827 | 1/1968 | Schmitz et al. | 493/2 |
| 3,775,937 | 12/1973 | Devan et al. | 53/75 |
| 3,885,372 | 5/1975 | Peres | 53/75 |
| 3,894,380 | 7/1975 | Poulsen | 53/75 |
| 3,973,375 | 8/1976 | Loveland | 53/75 X |

*Primary Examiner*—James F. Coan

*Attorney, Agent, or Firm*—Christensen, O'Connor, Johnson & Kindness

[57] ABSTRACT

A case sealing machine, wherein the position of cases moving through the machine is continuously monitored by a programmable controller that uses information about case position to control the operation of various flap folding and glue applying mechanisms, is disclosed. Cases are moved through the machine by a chain-driven flight bar conveyor mechanism. Case entry is prevented by a raised gate until the flight bar conveyor mechanism is synchronized. Thereafter, the gate is lowered and a power roller feeds the case into the machine. After entering the machine, a case is pushed through the machine by the flight bar conveyor mechanism. The programmable case sealing machine can be programmed to seal the top and/or bottom of the case. If the bottom is to be sealed, the bottom major flaps of the case are separated from the bottom minor flaps by a T-deck mechanism as the case enters the machine. If the bottom of the case was previously sealed, the T-deck is rendered inoperative by the program. As the case proceeds through the programmable case sealing machine, the leading one of the top minor flaps is folded rearwardly so as to lie between the top major flaps. Then, if the top of the case is to be sealed, a kicker is actuated to fold the trailing top minor flap forwardly, between the top major flaps. The duration of both the T-deck and kicker functions is programmable. The case is then moved between top and bottom glue heads, which apply glue (if programmed to do so) to the flaps in a programmed pattern. The case sealing machine can be programmed to apply glue in a stitch (e.g., intermittent) pattern or a continuous pattern. After the glue is applied, the top major flaps are folded over the top minor flaps (and the bottom major flaps under the bottom minor flaps, if the case bottom is being sealed) and the case moved under rollers that apply pressure, which causes the major flaps to adhere to the minor flaps in regions where glue was applied by the glue heads. In the event the case sealing machine jams and causes the flight bar conveyor mechanism to stop or slow down to an undesirably low speed, the case sealing machine is stopped and a jam display created.

24 Claims, 14 Drawing Figures

PROGRAMMABLE CASE SEALING MACHINE

TECHNICAL AREA

This invention is directed to case handling machines and, more particularly, to case sealing machines.

BACKGROUND OF THE INVENTION

In the past, various types of case handling machines have been developed. Case handling machines include machines for assembling cases, machines for sealing cases and machines for placing insert in cases, plus various combinations thereof. For example, some case handling machines both assemble and partially seal cases. Other case handling machines merely seal cases. In some instances, sealing is accomplished using an adhesively coated tape. In other cases, an adhesive is applied directly to the major and/or minor flaps of the case to be sealed. In some instances, both the bottom and the top of the cases are sealed after the case has been loaded with the object or objects to be stored in the case. In such instances, the case is partially assembled and, then, loaded. More specifically, the case is erected and the bottom major flaps folded over the bottom minor flaps. The top major and minor flaps of the case are left upstanding. The objects are loaded into the case as the case is supported by a suitable support medium, such as a conveyor. Thereafter, the case is conveyed to a case sealing machine that seals the bottom of the case at the same time the top is sealed. The present invention relates to the latter type of case sealing machines, i.e., case sealing machines having the capability of simultaneously sealing both the top and bottom of cases, or sealing either the top or the bottom of cases, as desired.

In the past, case sealing machines designed to seal both the top and/or bottom of cases have been either entirely manually controlled or semi-automatically controlled by a plurality of sensing switches actuated by lever arms impinged on by the case, as the case is moved through the machine. Manually controlled machines are undesirable because they are both slow and labor intensive. Semi-automatically controlled electro-mechanical machines have a number of other disadvantages. First, because sealing machines use glue to seal cases, glue is often spattered. Glue spatterd on sensing switches frequently affects the operation of such switches, often resulting in incorrect machine operation. When this occurs, the machine must be shut down and corrective cleaning and/or repair steps taken. Dirt and/or other debris present in the environment in which case sealing machines are used also can affect the operation of sensing switches. Also because sensing switches deteriorate relatively rapidly when opened and closed frequently, frequent switch replacement is often required. Another major disadvantage of prior art electro-mechanical machines is the difficulty in changing the manner and operation of such machines. Usually a switch arm must be re-adjusted and/or a timing wheel peg must be repositioned to change the relationship of an operative element (e.g., glue actuator, T-deck, kicker, etc.) and either the case or a timing wheel. Such changes require the services of tools and a mechanic. All of these disadvantages contribute to machine down time. Machine down time is undesirable for two reasons—the cost of related machine repair; and, the resultant idle time of the machine operator and employees filling the cases being sealed by the machine.

Thus, there is a need for a case sealing machine that uses a minimum number of position sensing switches, yet can be easily programmed to seal the top, bottom or both the top and bottom of a case as a case is moved through the machine, particularly such a machine formed of reliable integrated circuits that are readily programmable. The present invention is directed to providing such a machine.

SUMMARY OF THE INVENTION

In accordance with this invention, a programmable case sealing machine is provided. The case sealing machine includes a programmable controller that continuously monitors the position of cases moving through the machine and, based on case position information, controls the operation of the various flap folding and glue applying mechanisms of the machine. Case entry is prevented by a gate mechanism until the case movement mechanism is synchronized. After a case is fed into the machine it is moved through the machine by the case movement mechanism. If the bottom of the case is to be sealed, the bottom major flaps are separated from the bottom minor flaps as a case enters the machine. If the bottom of the case is not to be sealed (because, for example, it has been previously sealed), the mechanism for spreading the bottom flaps is rendered inoperative by the program. As the case proceeds through the machine, the leading top minor flap is folded rearwardly so as to lie between the top major flaps. Then, if the top flaps are to be sealed, the trailing top minor flap is folded forwardly so as to lie between the major top flaps. The case is then moved past the top and bottom glue heads, which apply glue (if programmed to do so) in a programmed pattern. Thereafter, the top major flaps are folded over the top minor flaps (and the bottom major flaps are folded under the bottom minor flaps, if the case bottom is to be sealed) and pressure is applied to cause the major flaps to adhere to the minor flaps in the regions where glue was applied by the glue heads.

In accordance with further aspects of this invention, preferably, the programmable controller is microprocessor based, i.e., formed of large scale integrated (LSI) circuits. Also, preferably, the programmable controller is programmed via a control display unit that includes a series of programming keys and an alphanumeric display. Further, preferably, the control/display unit includes a key operated run-program switch whose state determines whether the controller is in a run mode of operation or a program mode of operation. Moreover, preferably, the control/display unit includes a modify-read switch whose state determines if the program can or cannot be modified as a pass through the program is made when the run-program switch is in the program state. Finally, preferably, the display only displays a minimal number of characters, e.g., four.

In accordance with other aspects of this invention, preferably, the cases are moved through the case sealing machine by a chain-driven flight bar mechanism that is synchronized when a flight bar is in a specific position. Moreover, a case infeed switch detects the presence of a case at the infeed side of the gate. When the presence of a case is sensed and the chain-driven flight bar mechanism is synchronized, the gate is lowered. Thereafter, a power roller located upstream of the gate moves the case into the programmable case sealing machine.

In accordance with further aspects of this invention, preferably, case position is monitored by a chain position encoder coupled to the chain that moves the flight bars. Preferably, the chain position encoder produces pairs of quadrature related pulses as the flight bar chain is moved by a flight bar motor. The quadrature pulses are used to increment (or decrement if the chain moves backwards) a program counter. Also, preferably, the case sealer includes a T-deck that is actuated to allow the bottom major flaps of the carton to drop away from the bottom minor flaps as a case enters the machine, if the bottom of the case is to be sealed. Further, preferably, the case sealing machine includes a kicker that is actuated to "kick" or fold the trailing minor top flap forwardly. The duration of the T-deck and kicker operations are programmable via the control display unit.

In accordance with still further aspects of this invention, a case front switch is provided for detecting the leading end of a case at a predetermined position as the case is moved through the case sealing machine. When this position is reached the length of the glue pattern, the nature of the glue pattern and whether the top or bottom glue head (or both) is to emit glue are determined, based on the way the machine has been programmed. Preferably the glue pattern can be in the form of a stitch pattern or a continuous pattern.

In accordance with further aspects of this invention, preferably, the flight bar motor is controlled by the programmable controller such that the flight bar movement is stopped when abnormally long cartons are being sealed to prevent the flight bar from impinging on the gate and/or coming up under a case in the gate region and, thus, hampering the operation of the case sealing machine. Finally, preferably, the operation of the case sealing machine is stopped and a jam or overload display created if a case (or other item) becomes jammed in the machine and stops or significantly slows down the flight bar motor for an abnormal length of time.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
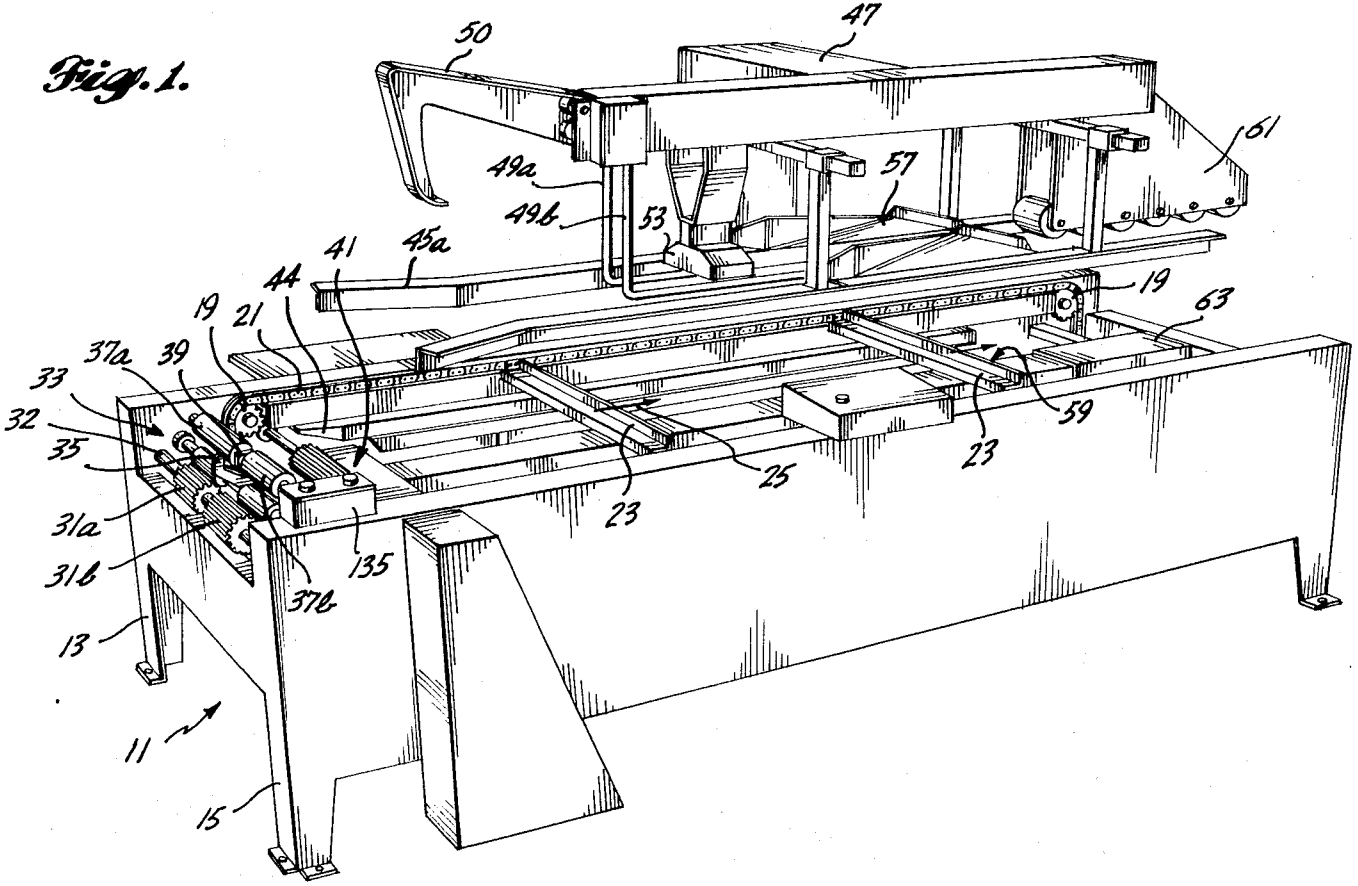
FIG. 1 is a pictorial diagram of the mechanical portion of a programmable case sealing machine formed in accordance with the invention.
Figure 2:
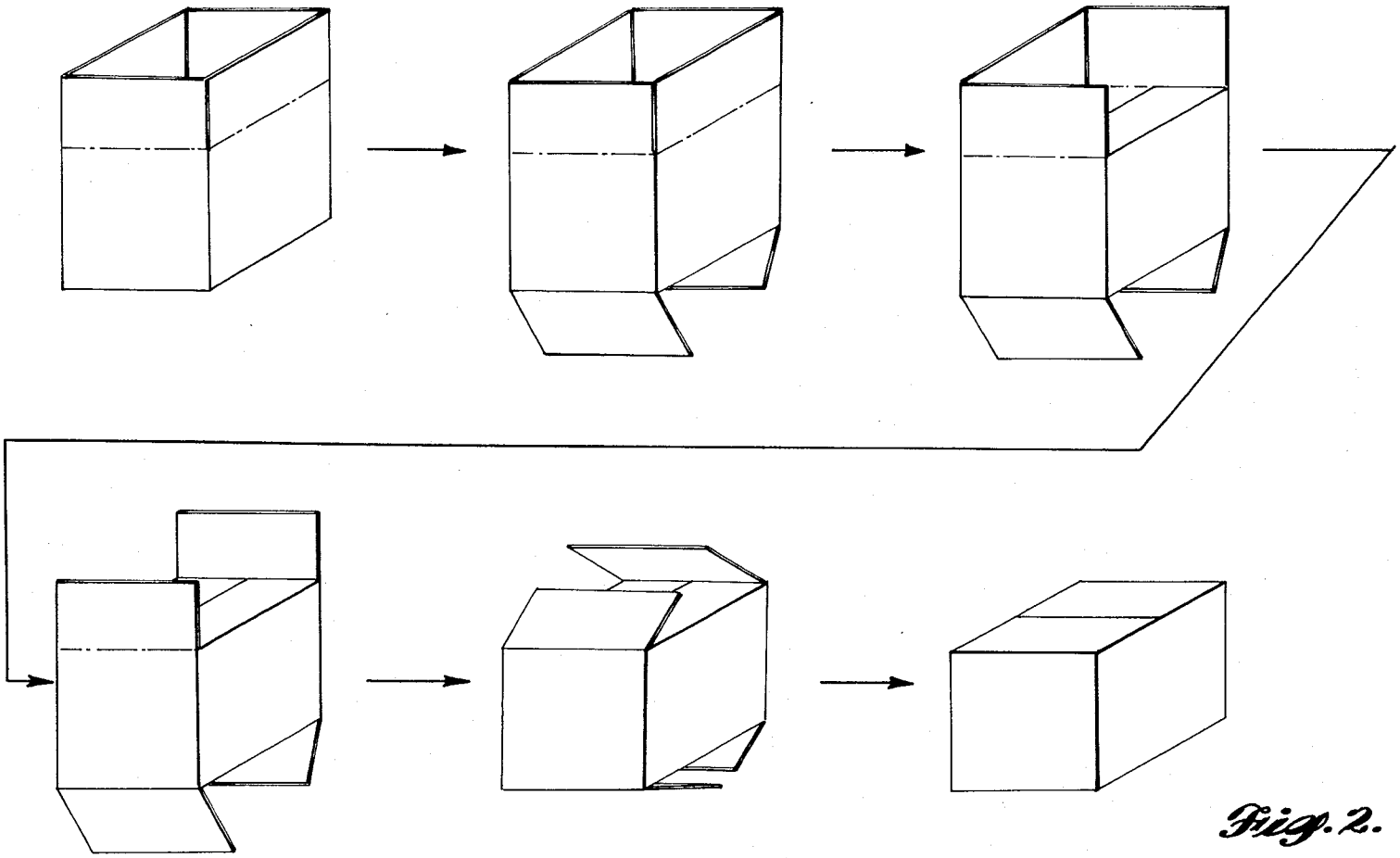
FIG. 2 is a pictorial diagram illustrating the sequence of positions of the top and bottom major and minor flaps of a case as it passes through the case sealing machine of the type illustrated in FIG. 1 when both the top and bottom of the case are to be sealed during a single pass through the machine.

FIG. 1 illustrates the mechanical portion of a programmable case sealing machine formed in accordance with the invention. Because the mechanical portion illustrated in FIG. 1 has been included in previously produced case sealing machines, it will not be described in detail. Rather, only the general layout of the major elements will be described because such a description will make the nature and operation of the other portions of the herein described programmable case sealing machine more readily understood.

The mechanical portion of the preferred embodiment of a programmable case sealing machine formed in accordance with the invention illustrated in FIG. 1 includes a base 11 having a pair of parallel oriented sidewalls 13 and 15. The inner faces of the sidewalls 13 and 15 each support a plurality of sprockets 19 that define mirror image paths of travel followed by a pair of chains 21, one of which is mounted on the sprockets 19 mounted on each of the walls. The chains support a plurality of flight bars 23. More specifically, the flight bars 23 are attached to and extend between the sidewall supported chains 21, so as to lie generally orthogonal to the vertical planes defined by the sidewalls. As a result, when the chains are moved by a flight bar motor (not shown), the flight bars are moved along a path of travel defined by the chains 21. In this regard, the path of travel defined by the chains 21 includes a relatively long upper run located near the upper edges of the sidewalls 13 and 15. It is along this run that the flight bars move when they push cases through the case sealing machine, as hereinafter described. The arrow 25 denotes the direction of case movement.

Located at the infeed end of the case sealing machine are a pair of spaced apart power-driven rollers 31*a* and 31*b*. The rollers are mounted on a common shaft 32. The outer surfaces of the power rollers 31*a* and 31*b* are longitudinally splined and the power rollers are oriented such that the axis of the shaft on which they are mounted lies transverse to the sidewalls 13 and 15. Thus, the axis of rotation of the power rollers 31*a* and 31*b* lies parallel to the longitudinal axis of the flight bars 23. The power rollers are driven by a suitable electric, pneumatic or hydraulic motor (not shown).

Located immediately downstream of the power rollers 31*a* and 31*b* is a gate 33. The gate includes a pair of rollers 37*a* and 37*b*. The gate rollers 37*a* and 37*b* are elongate and mounted on a common shaft whose axis lies parallel to the axis of the shaft 32 on which the splined power rollers 31*a* and 31*b* are mounted. Located between the pair of rollers and attached to the shaft on which the pair of rollers are mounted is one end of a bar 39. The other end of the bar 39 is attached to a suitable actuator (not shown). Preferably, the actuator is pneumatically operated. In any event, the actuator is sized and positioned to raise and lower the gate rollers. In their raised position the top of the gate rollers 37*a* and 37*b* lies substantially above the top of the power rollers 31*a* and 31*b* as shown in FIG. 1. In their lowered position (not shown) the top of the gate rollers lies at or beneath the level of the top of the power rollers. The difference in elevation is adequate for the gate rollers 37*a* and 37*b* to form a gate that prevents a case from entering the case sealing machine when the gate rollers are in their raised position even if the power rollers are rotating. Cases are, of course, fed to the power rollers by a suitable conveyor mechanism (not shown). As will be better understood from the following discussion, the gate rollers are raised to prevent a case from entering the case sealing machine until the flight bars are in a synchronized position. After the gate rollers are lowered and a case moved into the machine by the power rollers 31*a* and 31*b* the case is partially supported by the lowered gate rollers 37*a* and 37*b*. After the case enters the case sealing machine the gate rollers are raised to prevent the next case from entering the machine until the case sealing machine is ready for the next case.

Located between the pairs of power rollers 31*a* and 31*b* and the pair of gate rollers 37*a* and 37*b* is an actuator arm 35 connected to a case infeed switch (not shown). The actuator arm 35 is centered between the side walls 13 and 15. The actuator arm is supported and oriented such that it is impinged on and held down by a case stopped by the gate rollers, such hold down impingement causing the status of the case infeed switch to change from an open state to a closed state. The actuator arm remains down and, thus, the case infeed switch remains closed after the gate rollers are lowered, until the entire case passes over the actuator arm.

Located immediately upstream of the gate rollers 37*a* and 37*b* is the beginning of the long upper run of the path of travel of the flight bars 25. Located beneath the path of travel of the flight bars 23 is a T-deck 41. The T-deck includes a T-shaped support plate (when viewed from above) that is vertically movable. In the raised or upper position, the cross member of the T-deck supports an incoming case. The leg of the T-shaped support plate provides support for the center of the case as it is moved through the case sealing machine by the flight bars 23. In its lower position, the T-deck allows the bottom major flaps of a case entering the machine to drop and be held open by plows 43 located immediately upstream of the cross member of the T-deck. If the T-deck is raised, the plows support the case beneath the major flaps. If the T-deck is lowered the plows support the case beneath the minor flaps. The cases are directed to the plows by a pair of lower guide rails 44, which have converging upstream ends.

Lying above the plows and lower guide rails 44 are a pair of upper guide rails 45*a* and 45*b*. The upper guide rails 45*a* and 45*b* are supported by a superstructure that also supports a pair of L-shaped tubes 49*a* and 49*b* having vertical and horizontal runs that lie in vertical planes located between the upper guide rails 45*a* and 45*b*. The corners of the L-shaped bars are located such that they impinge on and fold the leading top minor flap of a case as the case is moved through the case sealing machine.

The superstructure 47 also supports a kicker 50 and the actuator therefor. The kicker 50 lies upstream of the L-shaped bars 49*a* and 49*b* and, when actuated, kicks or pushes the trailing top minor flap of a case downwardly and forwardly, between the upstanding top major flaps of a case, as the case is moved through the case sealing machine. (By definition the top and bottom flaps lying transverse to the direction of case movement 25 are the minor flaps and the top and bottom flaps lying parallel to the direction of case movement are the major flaps.)

Located near the downstream end of the L-shaped bars 49*a* and 49*b*, and therebetween, is a top glue head 53. A bottom glue head (not shown) is located at the end of the T-deck 41. Located downstream of the top glue head 53 is an upper flap folding mechanism 57 adapted to fold the top major flaps of acase downwardly and inwardly, i.e., toward one another, as a case is moved through the case sealing machine. A lower flap folding mechanism (not shown) adapted to fold the bottom flaps of a case upwardly and inwardly as a case is moved through the case sealing machine is located downstream of the bottom glue head. Located downstream of the flap folding mechanism are a plurality of pressure rollers 61 adapted to press a case against a lower support 63 as the case emerges from the flap folding mechanisms and, thereby, creating a case sealing force.

As noted above, the mechanical mechanism of the case sealing machine illustrated in FIG. 1 has been included in previously produced case sealing machines. Because this mechanism is known to those skilled in this art, it will not be described in more detail here.

Figure 3:
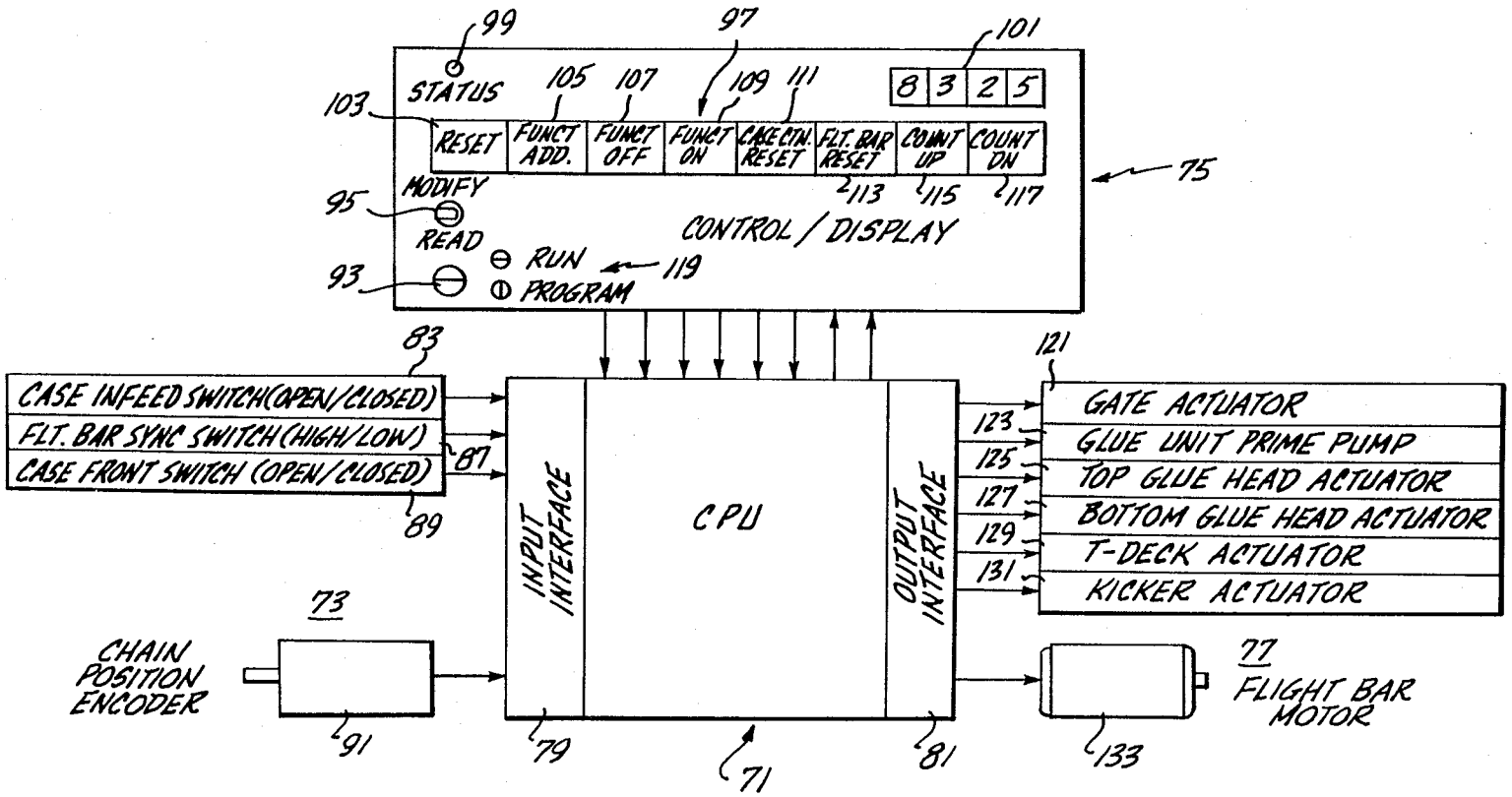
FIG. 3 is a block diagram illustrating a programmable case sealing machine formed in accordance with the invention.

FIG. 3 is a block diagram of a controller suitable for use in a programmable case sealing machine formed in accordance with the invention. The controller illustrated in FIG. 3 comprises: a central processing unit (CPU) 71; a plurality of input sensors 73; a control display unit 75; and, a plurality of controlled devices 77. In addition to a microprocessor, and suitable memory and other required devices, the CPU also includes an input interface 79 and an output interface 81.

The input sensors 73 include: a case infeed switch 83; a flight bar sync switch 87; a case front switch 89; and a chain position encoder 91. The case infeed switch 83 is the switch that is actuated by the actuator arm 35 (FIG. 1). As noted above, the closed/open state of the case infeed switch denotes the presence or absence of a case in front of the gate rollers 37*a* and 37*b*. The open/-closed status of the gate which denotes the up or down position of the gate rollers 37*a* and 37*b*, is determined by reading the gate command output of the output interface 81. The flight bar sync switch 87 is a magnetic switch located adjacent the path of travel of the flight bars 23 and positioned such that a magnet mounted on the flight bars actuates the switch causing it to switch from a normal low state to a high state during the period of time the fight bar magnet is in the switch sensing area. The case front switch is located at a suitable position between the gate rollers 37*a* and 37*b* and the glue heads. The case front switch is positioned to be closed by the front end of a case as a case moves through the programmable case sealing machine of the invention and remains closed until the case is past the case front switch. The chain position encoder 91 produces pairs of quadrature related pulses as the flight bar chain is moved by the flight bar motor. The case infeed switch 83, flight bar sync switch 87, case front switch 89 and chain position encoder 91 are all connected to the CPU 71 via the input interface 79.

The control/display unit 75 provides an operator interface to the CPU 71. The control/display unit includes: a run-program switch 93; a read-modify switch 95; a plurality of program keys 97; a status light 99; and, an alphanumeric display 101. The program keys 97 include: a reset key 103; a function-address key 105; a function off key 107; a function on key 109; a case count reset key 111; a flight bar reset key 113; a count-up key 115; and, a countdown key 117. The run-program switch 93 is, preferably, a two-position key operated switch—the two positions are denoted the run position and the program position. When in the run position the run-program switch 93 places the case sealing machine in a run mode of operation. In the program position the run-program switch places the machine in a program mode of operation. Preferably a run-program switch display 119 is provided to show the key positions for the two modes of operation. The use of a key switch has the advantage of preventing unauthorized or inadvertent reprogramming of the programmable case sealing machine. Preferably, the read-modify switch 95 is a two-position toggle switch that can be placed in either a read or a modify position. Preferably, the program keys 97 are momentary contact panel switches of the type utilized in a wide variety of electronic devices, such as calculators, keyboards, etc. The status light 99 is, preferably, a light-emitting diode (LED) covered with a suitably colored lens, e.g., a red lens. Preferably, the alphanumeric display 101 is a four-character display suitable for displaying either letters or numbers, as desired.

The devices 77 controlled by the CPU 71 include: a gate actuator 121; a glue unit prime pump 123; a top glue head actuator 125; a bottom glue head actuator 127; a T-deck actuator 129; a kicker actuator 131; and, a flight bar motor 133. The gate actuator 121 is a suitable actuator, such as a pneumatic actuator, coupled to the bar 39 attached to the gate rollers 37*a* and 37*b*. The gate actuator raises and lowers the gate rollers and, thus, closes and opens the gate. The glue unit prime pump is a pump required by certain types of glue heads. The glue unit prime pump pressures the glue heads prior to their being actuated to emit glue. When they receive an actuation signal from the CPU, the top and bottom glue head actuators cause glue to be emitted from their respective glue heads. Preferably, the top and bottom glue head actuators are pneumatic actuators. The T-deck actuator 129 raises and lowers the T-deck 41 and the kicker actuator 131 actuates the kicker 50. Preferably, both the T-deck actuator 129 and the kicker actuator are pneumatic actuators. While the gate, top glue head, bottom glue head, T-deck and kicker actuators are preferably pneumatic actuators, it is to be understood that any or all of these actuators could take the form of other types of actuators, specifically electric or hydraulic actuators, if desired. The flight bar motor 133 is an electric, hydraulic or air-operated motor whose shaft is connected to the flight bar chains 21. Thus, the flight bar motor 133 moves the flight bars (and, thus, cases to be sealed) through the programmable case sealing machine. The gate actuator 121, glue unit prime pump 123, top glue head actuator 125, bottom glue head actuator 127, T-deck actuator 129, kicker actuator 131 and flight bar motor 133 all receive actuation, deactuation or other types of command signals from the CPU via the output interface 81.

As will be appreciated from the foregoing description, the programmable case sealing machine illustrated in block form in FIG. 3 includes a minimal number of sensors—namely, three switches plus a chain position encoder. The information produced by these sensors in combination with the way the CPU is programmed by an operator via the control/display unit controls the sequence of operation of the programmable case sealing machine. While a minimal number of sensors are included, a wide variety of sequences of operation are possible depending upon whether or not the bottom, top or both of a case entering the machine are to be sealed. The CPU makes continual passes through a program with the branches followed during any pass being determined by various factors, such as the state of the run-program switch 93. If in the program state the CPU responds to the read-modify switch 95 and the actuation of the program keys 97. If in the read state, the CPU responds to the sensors and the way the machine was previously programmed via the control/display unit. The various paths or sequences of operation are illustrated in flow diagram form in FIGS. 4–13 and next described.

Figure 4:
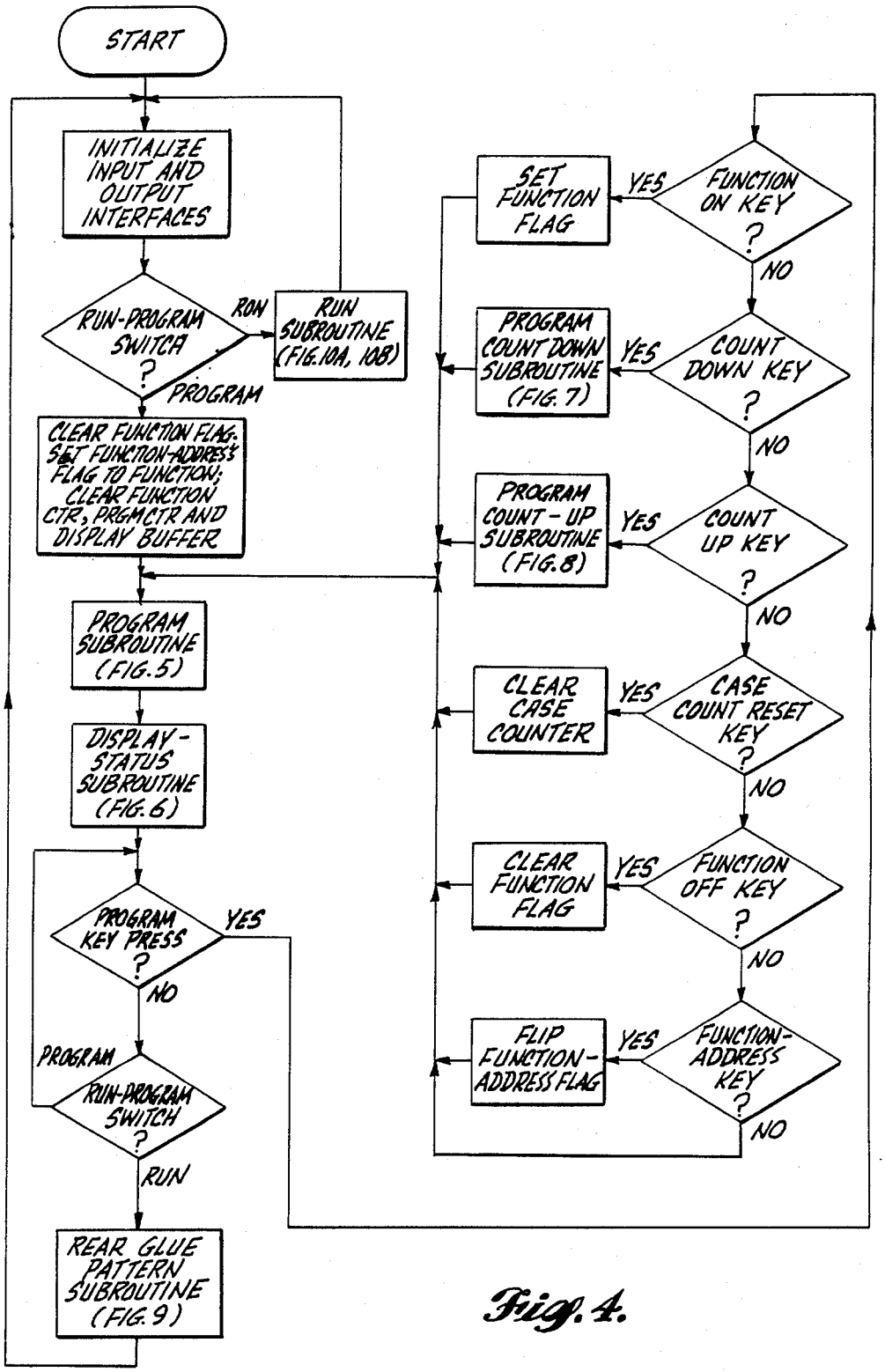
FIG. 4 is a flow diagram illustrating the main program (main sequence of operation) of the central processing unit (CPU) illustrated in FIG. 3.

FIG. 4 is a flow diagram illustrating the main program of a preferred embodiment of a programmable case sealing machine formed in accordance with the invention. When power is applied to the machine, or a power reset control switch 135 (FIG. 1) is actuated, the main program illustrated in FIG. 4 is entered. The first step in the main program is to initialize the input and output interfaces 79 and 81 (FIG. 3). Interface initialization involves setting up two input/output boards, such that one functions as an input interface and the other functions as an output interface. In addition to programming the boards such that one board functions as an input interface and the other as an output interface, the boards are programmed to produce and acknowledge interrupts and function in other manners well known to those skilled in the microprocessor art.

After the input and output interfaces have been initialized, a test is made to determine the status of the run-program switch. If the run-program switch is in the run position, a run subroutine, illustrated in FIGS. 10A and 10B and described below, is entered. If the run-program switch is in the program position, a function flag is cleared, a function-address flag is set to a function state and a function counter, a program counter and a display buffer are all cleared. In this regard, the program includes a plurality of "flags" that can be set or reset (e.g., cleared) in various manners. For example, when the function on key 109 is actuated, and the actuation is recognized during a pass through the herein described main program, the function flag is set. Similarly, when the function off key is depressed and that action is recognized during a pass through the main program the function flag is reset or cleared. The function-address flag is flipped from a function state (binary one) to an address state (binary zero) or vice versa each time the function-address key is actuated and such actuation is recognized as passed through the main program. Other flags are set and cleared during passes through various subroutines forming part of the main program, particularly the run subroutine, as will be better understood from the following description.

The CPU includes various counters (either discrete counters or counters created by suitable programming), including a function counter and a program counter. The number of states of the function counter is equal to the number of controllable functions that can be performed by the programmable case sealing machine. Six controllable functions can be performed by the preferred embodiment of the invention herein described—a T-deck function, a kicker function, a top glue head function, a bottom glue head function, a stitch function and a pattern length function. The T-deck, kicker, top and bottom glue head functions are on-off functions that have been described above. The stitch function is also an on-off function that determines whether the glue pattern is to be continuous (non-stitch) or intermittent (stitch). The pattern length function allows the length of the glue pattern (regardless of whether it is to be stitched or non-stitched) to be programmed. Because the preferred embodiment of the herein described programmable case sealing machine has six programmable functions, the function counter has six states (0–5). The program counter (PRGMCTR in the drawings) is a counter that is incremented or decremented by suitable increment and decrement pulses. The program counter can be incremented and decremented in two ways. First, by the actuation of the count up and count down keys when the run-program switch 93 is in the program position. Second, by the quadrature pulses produced by the chain position encoder when the run-program switch 93 is in the run position. In addition to the function counter, the program counter and other hereinafter described counters, the CPU includes a display buffer that stores display information utilized to control the nature of the characters displayed by the four character alphanumeric display 101.

Figure 5:
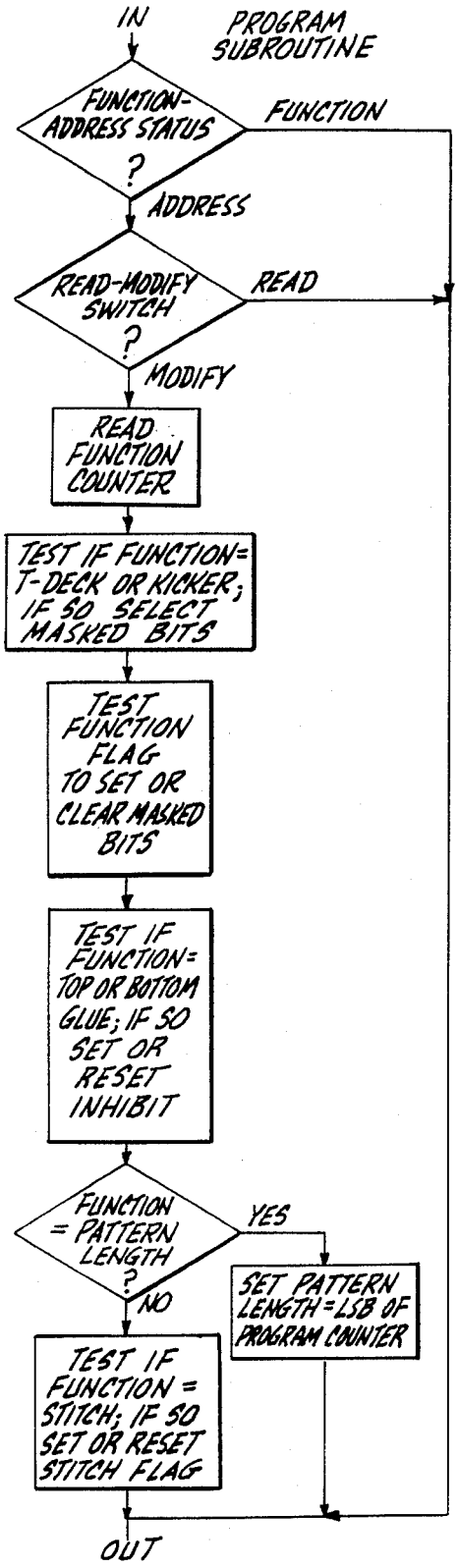
FIG. 5 is a flow diagram of a program subroutine suitable for inclusion in the sequence illustrated in FIG. 4.

Returning now to the main program (FIG. 4), after the function flag has been cleared, the function-address flag has been set to the function state, etc., the program subroutine illustrated in FIG. 5 is entered. The first step of the program subroutine is to test the status of the function-address flag. If the function-address flag is in the function state, the other steps of the programmed subroutine are bypassed and the sequence of operation of the programmable case sealing machine cycles to the display-status subroutine illustrated in FIG. 6 and described below. If the function-address flag is in the address state, a test of the read-modify switch 95 is made. If the read modify switch 95 is in the read state, the other steps of the program subroutine are again bypassed and the sequence of operation cycles to the display-status subroutine. If the read-modify switch 95 is in the modify state, the status of the function counter is read. If the function denoted by the status of the function counter is the T-deck or kicker function a selected bit is masked for change. The selected bit is a memory bit that is dedicated to the specific function—T-deck or kicker function. More specifically, the program counter functions both to define case position during the herinafter described run subroutine and to create memory address information. At each address data stored in memory is available. One specific bit of this data is dedicated to the T-deck function and another is dedicated to the kicker function. During programming these bits are masked for change when the function counter status is "pointing" to one or the other of these functions. Next, the function flag is tested to determine whether it is in a set or clear state. If the function flag is in a set state, the masked bit is set and if the function flag is in a clear state, the masked bit is cleared. This procedure is followed for each case position, i.e., each program counter value, for both the T-deck and the kicker functions.

Next a test is made to determine if the function denoted by the status of the function counter is either the top or bottom glue function. If the function is one or the other of these functions, an inhibit flag related to the appropriate device (e.g., top or bottom glue head), is set or reset based on whether the function flag is in a set or clear state. If the function flag is in a set state, the relevant top or bottom glue head inhibit flag is set. Contrariwise, if the function flag is in a clear state, the relevant glue head inhibit flag is reset.

Figure 6:
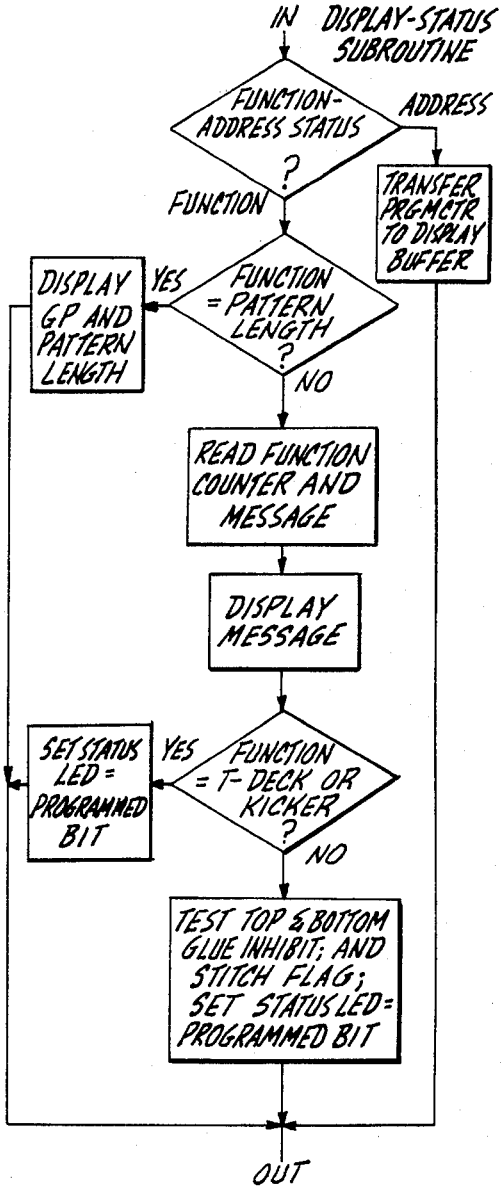
FIG. 6 is a flow diagram of a display-status subroutine suitable for inclusion in the sequence illustrated in FIG. 4.

Next a test is made to determine whether or not the function denoted by the status of the function counter is the pattern length function. If the function is the pattern length function, the least significant byte (LSB) of the program counter is read and stored in the masked bits as a pattern length value (PATL) for use during the hereinafter described run subroutine. If the function is not the pattern length function, a test is made to determine if the function denoted by the status of the function counter is the stitch function. If the function is the stitch function, the masked bit, which forms a stitch flag, is set or reset in accordance with the set/clear status of the function flag. If the function flag is in a set state, the stitch flag is set. Contrariwise, if the function flag is in the clear state, the stitch flag is reset. Threafter, illustrated in FIG. 4, the display-status subroutine illustrated in FIG. 6 is entered.

The first step in the display-status subroutine is a test of the status of the function-address flag. If the function-address flag is in the address state, the program counter status is transferred to the display buffer to create an alphanumerical display related to the decimal value of the number present in the program counter. If the function-address flag is in the function state, a test is made to determine whether or not the function is the pattern length function. If the function is the pattern length function, the first two characters of the display 101 are set to display two letters, such as GP, designed to denote that the glue pattern length function is being displayed. The second two characters of the four character display are then controlled to display the length of the glue pattern. By way of example only, the display could read GP10 to denote a glue pattern length of 1.4 inches. Thereafter, the display subroutine ends and the sequence of operation cycles to the main program illustrated in FIG. 4 and follows one of the paths described below.

If the function determined by the state of the function counter is not the pattern length function, the function counter is read and a suitable message related to the status of the function counter is displayed. Examples of suitable messages are: TDEK to denote the T-deck function; KICK to denote the kicker function; TPGH to denote the top glue head function; BMGH to denote the bottom glue head function; and, STCH to denote the stitch function. After the message has been displayed, a test is made to determine whether or not the function denoted by the status of the function counter is the T-deck or kicker function. If the function is one or the other of these two functions, the status LED is set equal to the programmed bit, i.e., the flag bit stored in memory at the address defined by the program counter value existing when this test is made. For example, if the T-deck function is programmed on at the program counter value (i.e., not inhibited) the status LED will be lit. Contrariwise, if the T-deck function is programmed off (i.e., inhibited) the status LED will be off. Similarly, if the kicker function is programmed on at the program counter value, the status LED will be lit. Contrariwise, if the kicker function is programmed off, the status LED will be off.

If the function counter status is not the T-deck or kicker function, a test of the top, bottom glue head inhibit and the stitch flags is made. The status LED is set to denote the related program bit, i.e., the bit programmed for the particular function. Specifically, the status LED is lit if the flag is set and off if the flag is clear. Thereafter the display-status subroutine ends and the sequence of operation returns to the main program illustrated in FIG. 4.

After a pass through the display-status subroutine (FIG. 6) has been completed, as illustrated in FIG. 4, a test is made to determine if any of the program keys 97 are being actuated (e.g., pressed). If a program key is being pressed, tests are made to determine if one of certain ones of the program keys is pressed and carries out the action commanded by such key actuation. First, a test is made to determine whether or not the function on key is pressed. If the function on key is pressed, the function flag is set. Thereafter, the main program cycles to the point where the program subroutine is entered. If the function on key is not pressed, a test is made to determine whether or not the countdown key is pressed. If the countdown key is pressed, a program countdown subroutine illustrated in FIG. 7 is entered.

Figure 7:
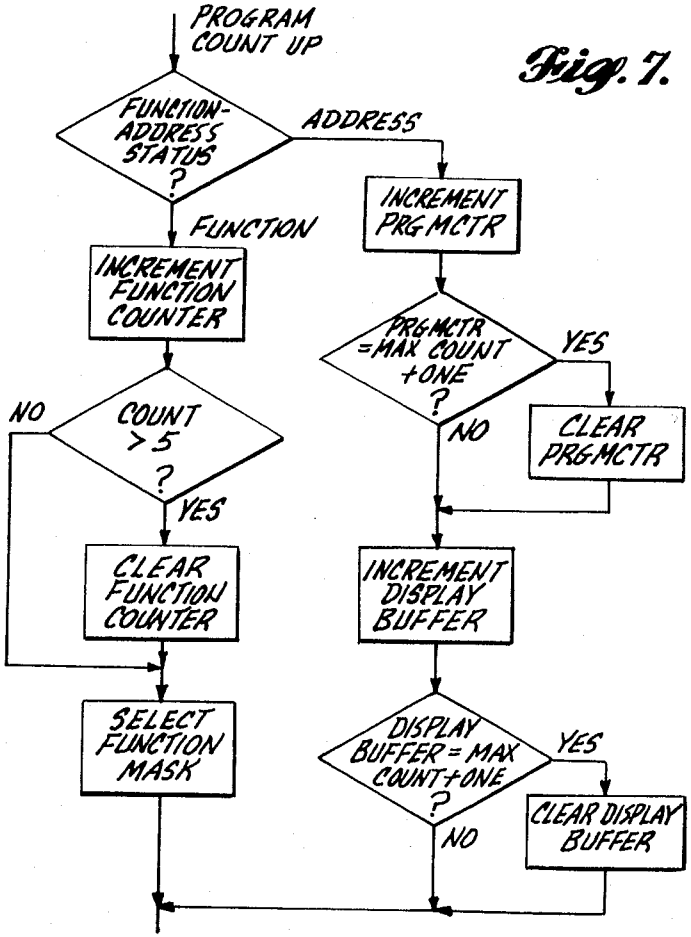
FIG. 7 is a flow diagram of a program countdown subroutine suitable for inclusion in the sequence illustrated in FIG. 4.

The first step of the program countdown subroutine illustrated in FIG. 7 is a test of the function-address flag. If the function-address flag is in the function state, the function counter is decremented. Thereafter, a test is made to determine whether or not the count value of the function counter is less than zero. If not less than zero, a function mask determined by the status of the function counter is selected. If the status of the function counter is less than zero, the function counter is set equal to five and, then, the related function mask is selected. Thereafter, the program countdown subroutine ends and the sequence of operation cycles to the point in the main program where the program subroutine is entered, as illustrated in FIG. 4.

If the function-address flag is in the address state when the program countdown subroutine is entered, the program counter is decremented, as illustrated on the right side of FIG. 7. Thereafter, the value of the program counter is tested to determine whether or not it is equal to zero. If it is not equal to zero, the display buffer is incremented. If the program counter value is less than zero, the program counter is set equal to the predetermined maximum value to which the program counter can be incremented. Thereafter, the display buffer is incremented. After the display buffer is incremented a test is made to determine whether or not the display buffer value is less than zero. If the display buffer value is less than zero, the display buffer is set to equal to the predetermined maximum value to which the display buffer can be set. Regardless of the path followed, after the display buffer value has been tested, and set to its maximum value, if required, the program countdown subroutine ends and the sequence of operation cycles to the point in the main program where the program subroutine is entered, as shown in FIG. 4.

If the countdown key is not pressed, then, as shown in FIG. 4, a test of the count-up key is made to determine whether the count-up key is pressed. If the count-up key is pressed, a program count-up subroutine (illustrated in FIG. 8) is entered.

The first step in the program count-up subroutine is a test of the function-address flag. If the function-address flag is in the function state, the function counter is incremented. Then, the status of the function counter is tested to determine whether or not it is greater than five. If greater than five, the function counter is cleared, i.e., set equal to zero. After the function counter has been tested and cleared, if necessary, the function mask related to the status of the function counter is selected. Thereafter, the program count-up subroutine ends and the sequence of operation cycles to the point in the main program where the program subroutine is entered.

Figure 8:
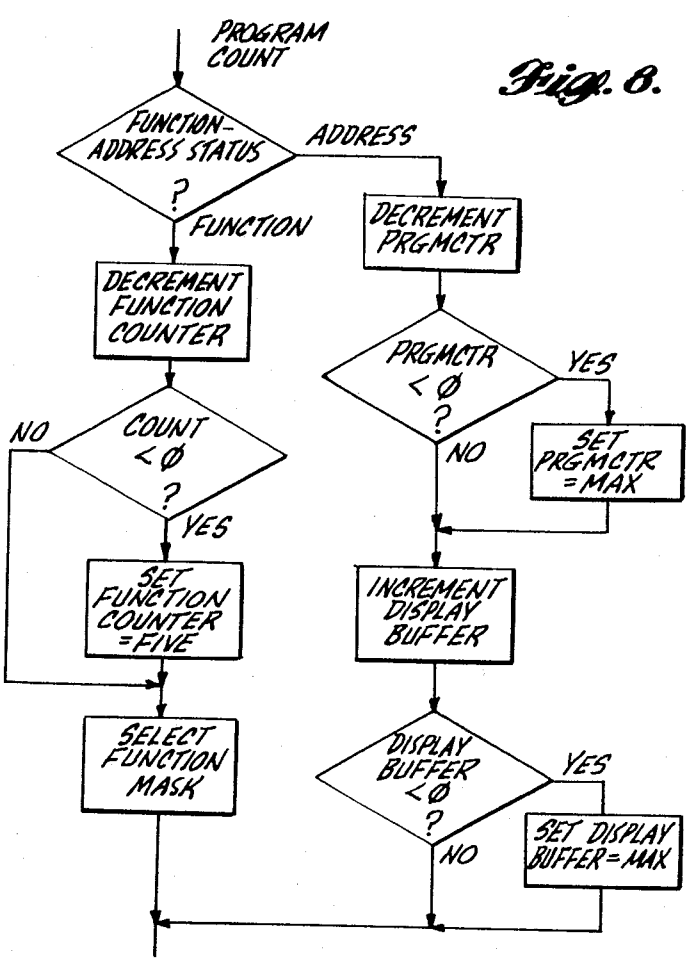
FIG. 8 is a flow diagram of a program count-up subroutine suitable for inclusion in the sequence illustrated in FIG. 4.

If the state of the function-address flag is the address state, the program counter is incremented, as illustrated on the right side of FIG. 8. Thereafter, the program counter is tested to determine whether the program counter value is equal to the predetermined maximum program counter value plus one. If the program counter value is equal to the program counter maximum value plus one, the program counter is cleared. After the program counter value has been tested and the program counter cleared, if required, the display buffer is incremented. Thereafter, the display buffer is tested to determine whether the display buffer value is equal to the maximum display buffer value plus one. If the display buffer value is equal to the maximum display buffer value plus one, the display buffer is cleared. After the display buffer has been tested and cleared, if required, the program count-up subroutine ends and the sequence of operation of the programmable case sealing machine cycles to the point in the main program where the program subroutine is entered, as illustrated in FIG. 4.

If the test of the count-up key determines that the count-up key is not pressed, a test is made to determine whether or not the case count reset key is pressed. If the case count reset key is pressed, the case counter is cleared. After the case counter is cleared, the main program cycles to the point where the program subroutine is entered. If the case count reset key was not pressed, a test is made to determine whether or not the function off key is pressed. If the function off key is pressed, the function flag is cleared and the main program cycles to the point where the program subroutine is entered. If the function off key is not pressed, a test is made to determine whether or not the function-address key is pressed. If the function-address key is pressed, the function-address flag is flipped, i.e., changed from the function state to the address state, or from the address state to the function state. After the function address flag has been flipped or if the function address key was not pressed, the main program cycles to the point where the program subroutine is entered.

Turning now to the remainder of the main program set forth in the lower left-hand corner of FIG. 4, if the program key press test determines that no key is being pressed, a test of the run-program switch 93 is made. If the run-program switch is still in the program position the main program cycles back to the point where the program key press test is made. This loop is repeated until a program key is pressed or the run-program switch 93 is changed to the run position. When the test of the run-program switch 93 determines that the switch has been shifted to the run position, the loop illustrated in FIG. 4 and just described is left and the rear glue pattern subroutine (FIG. 9) is entered.

The first step of the rear glue pattern subroutine is to delete glue information from memory. The next step is to read rear glue end position information from memory. The rear glue end position information is a stored number constant related to the program counter value. A constant is used for the rear glue end position since the rear glue end position is related to the position of the flight bars (and thus the position of cases), which are syncronized to the program counter during the run subroutine hereinafter described. After the rear glue end position information has been read from memory, the length of the glue pattern, which was previously entered during the programming sequence, is substracted from the rear glue end position value. The result of the subtraction determines the glue start position (in terms of a program counter value), which is stored for future use.

Figure 10A:
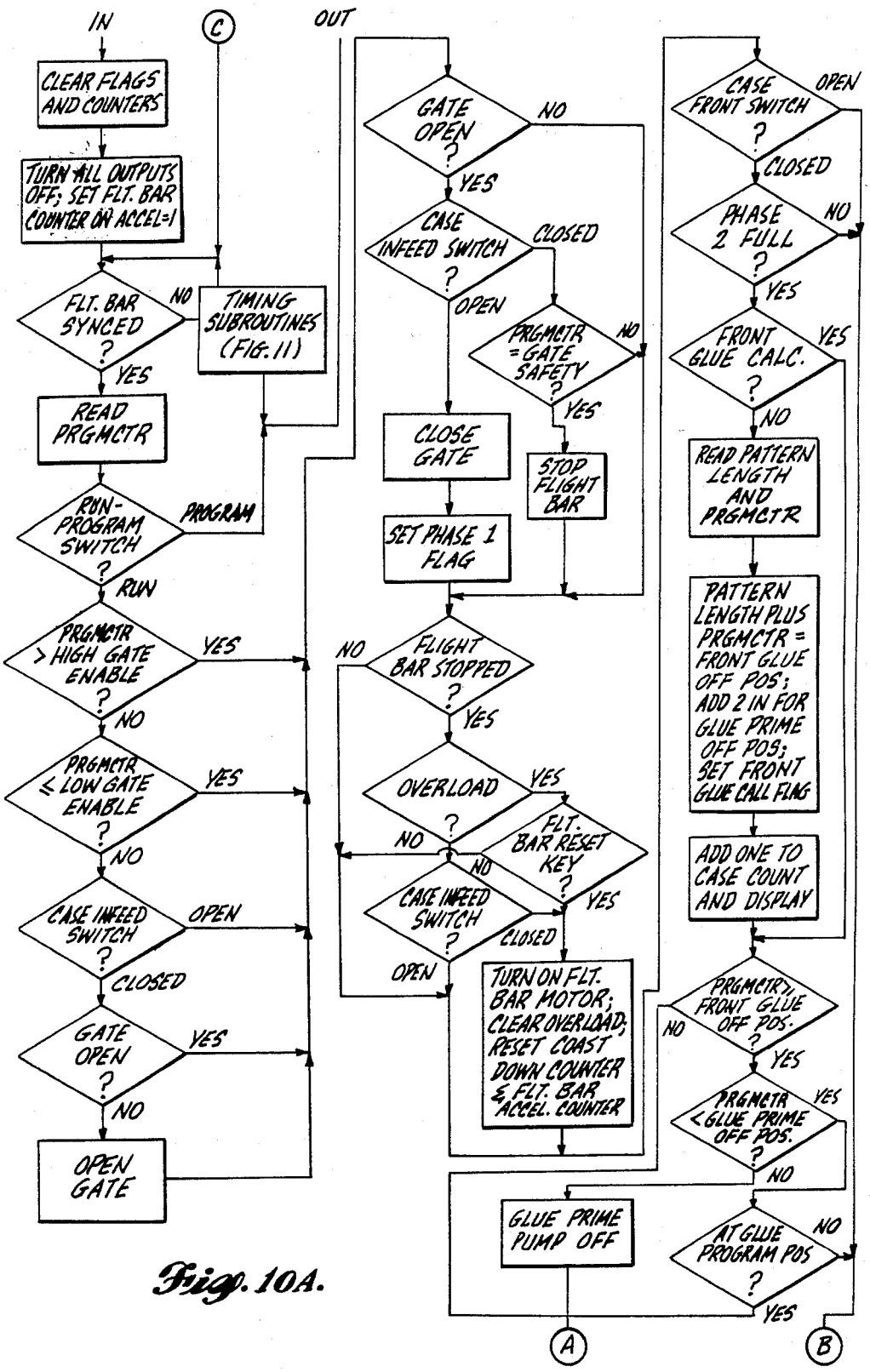
FIGS. 10A and 10B are a flow diagram illustrating a run subroutine suitable for inclusion in the sequence illustrated in FIG. 4.
Figure 10B:
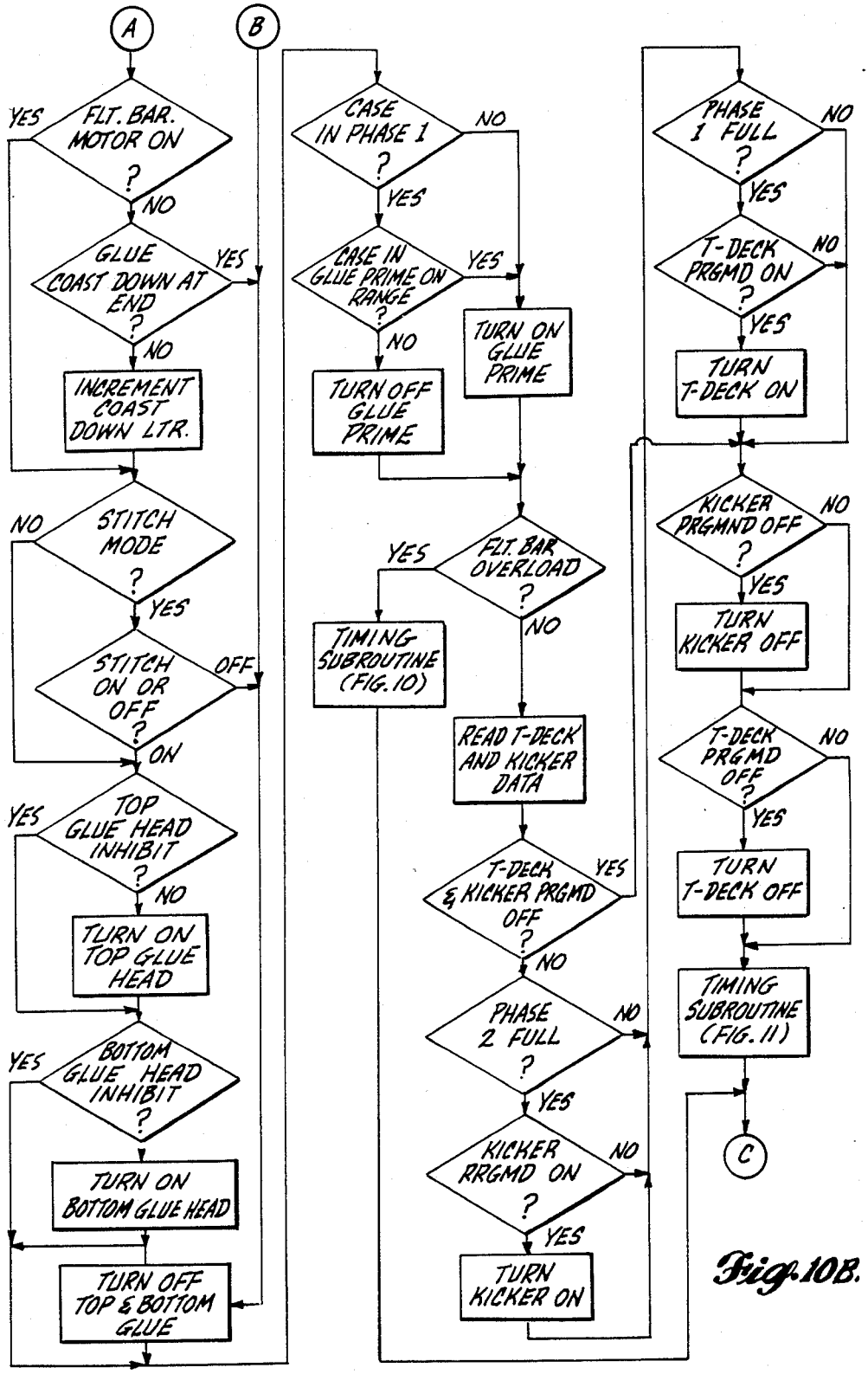
Figure 11:
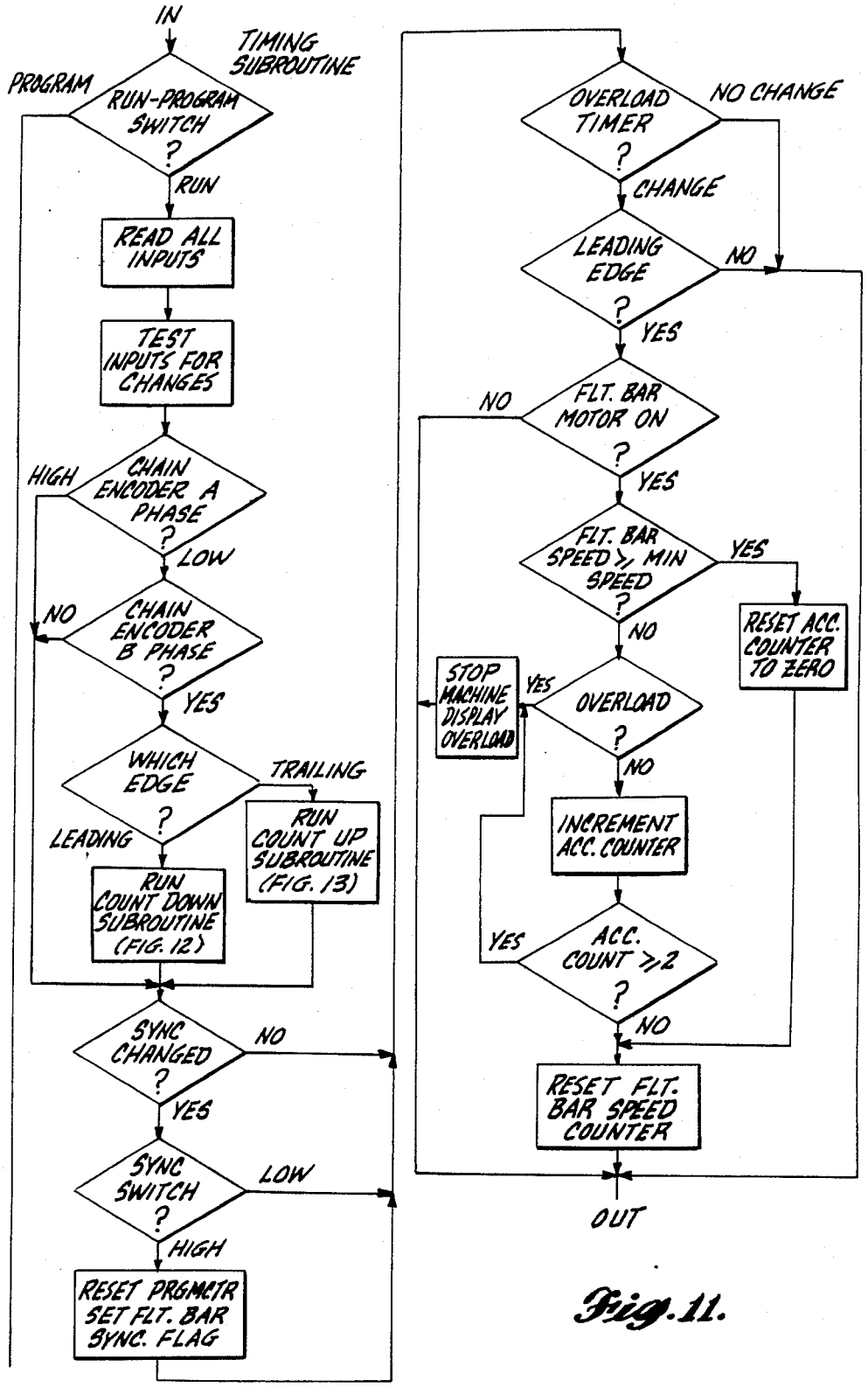
FIG. 11 is a flow diagram of a timing subroutine suitable for use in the run subroutine illustrated in FIGS. 10A and 10B.

Turning now to the run subroutine illustrated in FIGS. 10A and 10B. This subroutine is entered when the run-program switch test set forth in the upper left-hand corner of the main program (FIG. 4) determines that the run switch 93 is in the run position. The first step in the run-program subroutine is to clear all flags and counters. The next step is to turn all of the output signals off and set a further counter, denoted the flight bar counter, on an acceleration value equal to one (1). In essence, the flight bar counter is a three state (zero, one and two) flag, as opposed to the previously described flags, which are two state (zero and one) flags. In any event, after the flight bar counter has been set to an acceleration value equal to one (1), a test is made to determine whether or not a flight bar sync flag has been set. If not, the timing subroutine illustrated in FIG. 11 is entered.

The first step in the timing subroutine is a further test of the run-program switch 93 to determine if it is in the program or the run position. If the run-program switch is in the program position not only the timing routine, but also the run subroutine, ends and the sequence of operation of the programmable case sealing machine cycles to the point in the main program (FIG. 4) where input and output interfaces are initialized.

If the run-program switch test that occurs at the beginning of the timing subroutine (FIG. 11) determines that the run-program switch is in the run position, all of the sensor inputs are read and stored. (The sensor inputs are illustrated in FIG. 3 and were described above.) After all of the sensor inputs have been read and stored, they are tested for changes. Next a test is made of the chain position encoder signals. As noted above, the chain position encoder produces two pulse train signals that are quadrature related and contain information about the direction and change in position of the flight bars. The quadrature signals are denoted the phase A and phase B signals in FIG. 11 The first test of the chain position encoder signals is a test of the phase A signal to determine if it is in a high state or a low state. If the phase A signal is in a high state, the timing subroutine cycles to a sync changed test described below. If the A phase signal is in a low state, the B phase signal is tested to determine whether or not the B phase signal has changed from a high state to a low state or from a low state to a high state since the last test of the B phase signal that occurred when the A phase signal was low. If the B phase signal has not changed, the timing subroutine cycles to the sync changed test described below. If the B phase signal has changed, a test is made to determine whether the change occurred in the leading or the trailing edge of the signal. If the change was a leading edge change, i.e., the B phase signal shifted from a low state to a high state, the run countdown subroutine illustrated in FIG. 12 is entered.

Figures 9, 12, 13:
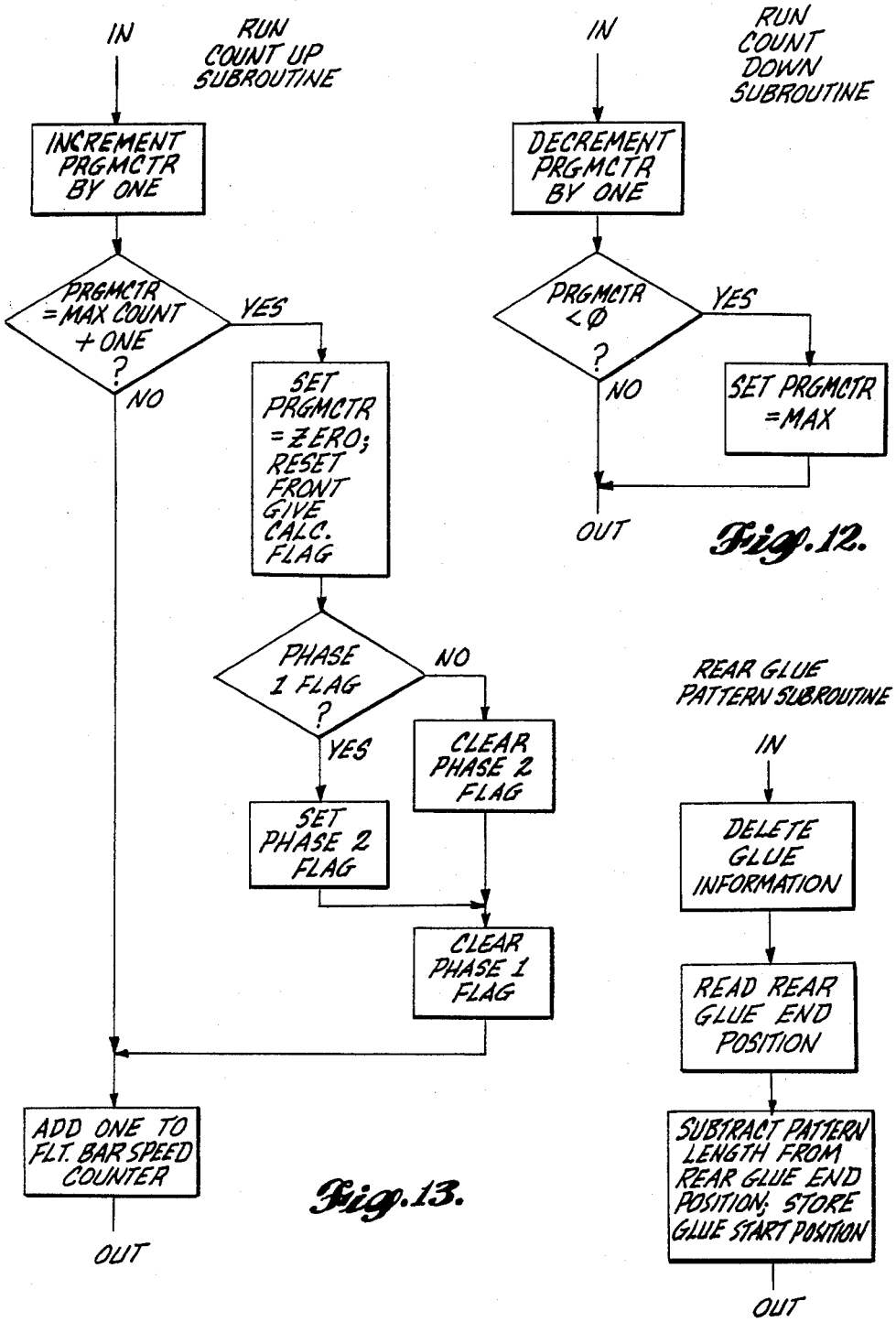
FIG. 9 is a flow diagram of a rear glue pattern subroutine suitable for inclusion in the sequence illustrated in FIG. 4.
FIG. 12 is a flow diagram of a run countdown subroutine suitable for use in the timing subroutine illustrated in FIG. 11; and, FIG. 13 is a flow diagram of a run count-up subroutine suitable for use in the timing subroutine illustrated in FIG. 11.

The first step of the run countdown subroutine illustrated in FIG. 12 is decrementing the program counter by one. Then a test is made of the program counter to determine whether or not the count value stored therein is less than zero. If the value is less than zero, the program counter is set to the predetermined maximum value. (This maximum value is the same as the predetermined maximum value to which the program counter may be set during a pass through the program countdown subroutine illustrated in FIG. 7 and previously described.) After the program counter has been tested and set to its maximum value, if required, the sequence of operation of the programmable case sealing machine cycles to the point in the timing subroutine where the sync change test is made, as illustrated in FIG. 11.

If the test of the edge of the B phase signal shifted from a high state to a low state, the run count-up subroutine illustrated in FIG. 13 (rather than the run countdown subroutine) is entered. The first step in the run count-up subroutine is incrementing the program counter by one. Than a test is made to determine whether the program counter value is equal to the maximum count value plus one. If the program counter value is equal to the maximum count value plus one, the program counter is reset to zero. Further, a front glue calculation flag is reset or cleared. Next a test is made to determine whether or not a PHASE 1 flag has been set. The PHASE 1 flag is set during the run subroutine in the manner hereinafter described when a case has passed through the gate of the herein described programmable case sealing machine. If the PHASE 1 flag is set, a PHASE 2 flag is set. If the PHASE 1 flag is not set, the PHASE 2 flag is cleared. After the PHASE 2 flag is set or cleared, as determined by the state of the PHASE 1 flag, the PHASE 1 flag is cleared. After the PHASE 1 flag is cleared, or if the program counter value was not equal to the maximum count plus one, one is added to a flight bar speed counter, which measures the speed of movement of the flight bar. Thereafter, the run count-up subroutine ends and the sequence of operation of the programmable case sealing machine cycles to the point in the timing subroutine where the sync change test is made, as illustrated in FIG. 11.

At this point, it will be appreciated that both the direction and distance of movement of the chains moving the flight bars has been determined and the program counter incremented or decremented in accordance therewith. If the flight bars are backed up beyond a zero (sync) position, the program counter is reset to a maximum value, which is then decremented if the flight bars are backed up further. When the flight bars reach a predetermined position, defined as the position at which the program counter reaches a maximum value, information about the presence of a case in an infeed phase of operation of the programmable case sealing machine (PHASE 1) is shifted to a glue phase of operation (PHASE 2). The information is shifted by setting a PHASE 2 flag if the PHASE 1 flag was set. As a result, two cases can be simultaneously handled by the programmable case sealing machine, rather than requiring that one case be completed before another case is allowed into the machine.

After the encoder signals have been analyzed, test is made to determine if the sync switch information has changed, i.e., the output of the sync switch has shifted from a low state to a high state or shifted from a high state to a low state. This is the previously referred to sync change test. If a change has occurred, a test is made to determine whether or not the sync switch state is high or low. Both tests combined determine whether or not the sync change is a leading edge or trailing edge change. If a high change occurs, the program counter is reset and a flight bar sync flag is set. After the program counter has been reset and the flight bar sync flag has been set, or if the no sync change has been detected or if the sync switch is in a low state, a test is made of an overload timer.

The overload timer test is a test to determine whether or not a predetermined number of encoder pulses occur during a particular time period. In this regard the central processing unit includes a timer whose output switches back and forth at some fixed rate. The frequency of the timer is low when compared to the frequency of the encoder pulses when the flight bar is moving at a normal rate. It is the output of this timer that is tested during the overload timer test. If no change in the output of the overload timer has occurred when the overload timer test takes place, the entire sequence of steps set forth on the right side of FIG. 11 are bypassed and the sequence of operation of the programmable case sealing machine cycles to the point in the run program illustrated in FIG. 10A where the flight bar sync test takes place. If a change in the output of the overload timer has occurred, the change is tested to determine whether it was leading edge (low to high) change or a trailing edge (high to low) change in the timer output. If the change was a trailing edge change, the remaining steps of the timing subroutine are again bypassed. If the change was a leading edge change, a test of the flight bar motor is made to determine whether the motor is on or off. If the flight bar motor is off, the remaining steps of the timing subroutine are again bypassed. (If either of these bypass situations exist, the sequence of operation shifts to the point in the run program where the flight bar sync test takes place.)

If the flight bar motor is determined to be on, a test is made to determine whether or not the flight bar speed is equal to or greater than a minimal speed value. This is determined by testing a flight bar speed counter to determine its count value. (The flight bar speed counter is incremented by the same pulses that increment the program counter.) If the flight bar motor is moving at or above the minimum speed value, the acceleration counter is reset to zero. Thereafter, the flight bar speed counter is reset to zero and the sequence of operation of the programmable case sealing machine cycles to the point in the run subroutine where the flight bar sync test takes place. If the flight bar speed is less than the minimal speed value, a test is made to determine whether or not an overload flag is set. If the overload flag is set, the operation of the programmable case sealing machine is stopped (or the machine is maintained in a stop state), an overload flag is set (or maintained set) and an overload (OVLD) display created. Then, the sequence of operation of the programmable case sealing machine shifts to the point in the run subroutine where the flight bar sync test takes place. If the overload flag is not set, the acceleration counter is incremented. Then, the acceleration counter is tested to determine whether or not its value is equal to or greater than two (2). If the acceleration count value is equal to or greater than two (2), the sequence of operation proceeds to the stop machine—set overload flag—create overload display step. If the acceleration count value is not greater than or equal to two (2), the flight bar speed counter is reset and the sequence of operation of the programmable case sealing machine cycles to the point in the run subroutine illustrated in FIG. 10A where the flight bar sync test takes place The reason for the increment acceleration counter step and the subsequent test of the acceleration counter value is to allow at least three (3) cycles of machine operation to occur prior to machine shutdown. In this regard, if these steps were not included, the programmable case sealing machine would stop shortly after pushing of the start button, since right after start-up flight bar speed is low. As a result, the overload timer would not be reset, the flight bar motor would be on and the flight bar speed would be less than the desired minimum speed. The three passes through the timing subroutine that must occur after the machine is turned on, before machine shutdown can occur, is normally adequate for the flight bars to accelerate to a speed value greater than the minimum speed value. As a result, the acceleration counter is normally reset to zero after the programmable case sealing machine is started, rather than machine shutdown occurring.

After each pass through the timing subroutine, the flight bar sync test is made. After the flight bars reach a sync position and the sync flag is set during a pass through the timing subroutine, the result of the flight bar sync test shifts from negative to positive. The next step in the run program is to read the program counter. Thereafter, the state of the run-program switch 93 is tested. If the run-program switch has been shifted from the run position to the program position, the run subroutine ends and the sequence of operation of the programmable case sealing machine cycles to the point in the main program (FIG. 4) where the input and output interfaces are initialized. If the run-program switch is in the run position, the program counter is tested to determine whether its value is greater than a predetermined high-gate enable value, which is a fixed value stored in memory. If the program counter value is greater than the high-gate enable value, the program counter is tested to determine whether its value is less than or equal to a predetermined low gate enable value, which is also a fixed value stored in memory. The high-gate enable and low-gate enable tests are designed to look for a "window" in the program counter value during which the gate can be opened. If either of these tests are positive, the run subroutine cycles to a second gate open test described below. If both the high-gate enable and the low-gate enable tests are negative, a test of the case infeed switch 83 is made. If the case infeed switch 83 is open (meaning that the actuator of the case infeed switch is not being impinged on by a case), the run subroutine cycles to the second gate open test described below. If the case infeed switch is closed, a test is made to determine whether or not the gate is open or closed. If the gate is closed, a gate open command is produced. If the gate is open, or, if closed, after the gate open command is produced, the second gate open test occurs. The second gate open test is made to determine whether or not the gate is open after it was commanded to open, or to determine if the gate is open when the just described tests are bypassed.

If the second gate open test is negative, the run subroutine cycles to the point where a flight bar stop test is made, described below. If the gate is open when the second gate open test occurs, the case infeed switch is tested. If the case infeed switch is open, meaning that a case is not impinging on the actuator of the case infeed switch, the gate is closed and the PHASE 1 flag is set to denote the presence of a case in the infeed phase of the programmable case sealing machine.

As will be appreciated at this point in the description, after synchronization has occurred a test is made to determine the presence of a case on the upstream side of the gate. When a case is detected at this position the gate is lowered (opened) to allow the case to enter the programmable case sealing machine. After the case has fully passed through the gate as determined by the case infeed switch opening, the gate is closed and the PHASE 1 flag is set.

during the period of time a box is entering the machine, the gate is open but the case infeed switch is closed. This situation is detected by the second gate open test and the subsequent case infeed switch test. When this situation exists, the program counter is tested to determine whether its count value is equal to a gate safety count value. In this regard, as long as the flight bar motor is on, a flight bar is continuously approaching the gate during the period of time a box is entering the machine. It is necessary for the box to fully enter the machine before the flight bar can impinge on the trailing edge of the case. When a long case is being fed into the programmable case sealing machine, the flight bar could reach a position where it impinges on a portion of the gate mechanism and/or the underside of the case, if the case is not fully in the machine in time for the gate to close before such impingement occurs. The gate safety count value is a count value that is reached by the program counter before such impingement can occur. If the gate safety value test is positive, flight bar movement is stopped (by de-energizing the flight bar motor). If the gate safety value test is negative, the stop flight bar step is bypassed. After the gate safety value test is performed and the flight bar stopped, if required, the run subroutine cycles to the flight bar stopped test.

If the flight bar stopped test is negative, the run subroutine cycles to a case front switch test described below. If the flight bar stopped test is positive a test is made to determine if the overload flag is set. In this regard, as will be appreciated from the following description, each time a pass through the run subroutine is made a pass through the timing subroutine is made. During the timing subroutine pass, the overload flag can be set in the manner described above during the passes through the timing subroutine that occur prior to flight bar synchronization. If the overload flag is set, a test of the flight bar reset key is made. If the flight bar reset key has not been pressed, the run subroutine cycles to the case front switch test described below. If the flight bar reset key has been pressed, the flight bar motor is turned on, the overload flag is cleared, a coast-down counter (described below) is cleared and the acceleration counter is cleared. If the overload flag is not set, the case infeed switch 83 is tested. If the case infeed switch is open, the run subroutine cycles to the case front switch test. If the case infeed switch is closed, the flight bar motor turn-on, overload clear, reset coast-down and flight bar acceleration counter clear steps occur. Thereafter, the run subroutine cycles to the case front switch test.

If the case front switch 89 is open, the run subroutine cycles to a turn-off top and bottom glue step (FIG. 10B), described below. If the case front switch is closed, the PHASE 2 flag is set during a pass through the timing subroutine occurring later in the run subroutine, as described below. If the PHASE 2 flag is not set, the run subroutine cycles to the turn-off top and bottom glue step described below. If the PHASE 2 flag is set (i.e., a case is in the glue phase of operation), a front glue calculation flag is tested. If the front glue calculation flag is set, the run subroutine cycles to a program counter value equal to or greater than the front glue off position test described below. If the front glue calculation flag is not set, a front glue calculation occurs. The front glue calculation is a calculation designed to determine the front position of the case when glue is to be turned off and the front position of case when the glue prime pump is to be turned off. The first steps in the calculation are to read the pattern length information stored in memory and read the value of the program counter. The pattern length information is added to the program counter value. The result defines the front glue off position and is stored for future use. In addition, the binary number equal to two inches (or some other pre-chosen value) is added to the front glue off position value. The value is also stored in memory for future use. Thereafter, the front glue calculation flag is set. Next, one is added to the case count and the result is displayed.

After the front glue calculation flag is set (or the setting steps are bypassed) in the manner previously described, a test is made to determine if the case is at the front glue off position. This step is accomplished by testing the program counter to determine whether its value is equal to or greater than the front glue off position value determined during the steps just described. If the case is not at the front glue off position the run subroutine cycles to a flight bar motor on test (FIG. 10B). If the case is at the front glue off position, a test is made to determine if the case is at the glue prime off position. This test is accomplished by testing the program counter to determine whether its value is less than the glue prime off position value determined during the just described steps. If the program counter value is greater than the glue prime off position value, the glue prime pump is turned off. Thereafter the run subroutine cycles to the flight bar motor on that (FIG. 10B). If the program counter value is less than the glue prime off position value, a test is made to determine whether or not glue is to be emitted at the case position determined by the program counter value. If glue is not to be applied at the case position, the run subroutine cycles to the turn-off top and bottom glue step illustrated in FIG. 10B and described below. If glue is to be applied at the case position, the run subroutine cycles to the flight bar motor on test illustrated in FIG. 10B and next described.

If the flight bar motor is on, the run subroutine cycles to a stitch mode test described below. If the flight bar motor is not on, a test is made to determine whether or not a period, denoted the glue coast-down period, is at an end. In this regard, the flight bar motor does not include a brake. Thus, after power to the flight bar motor ends, a predetermined (known) period of time elapses before the shaft of the flight bar stops rotating. This period time is the coast-down period. If the coast-down period is ended, as determined by the state of a coast-down counter, the run subroutine cycles to the turn-off top and bottom glue step described below. If the coast-down period is not at an end, the coast-down counter is incremented.

After the coast-down counter has been incremented, the stitch mode test is made. The stitch mode test is a test to determine whether the stitch mode has been programmed. If the stitch mode has not been programmed the run subroutine cycles to a top glue head inhibit test described below. If the stitch mode has been programmed, a test is made to determine if the stitch should be on or off. In this regard, as noted above, the stitch mode is a mode of operation where glue is turned on, turned off, turned on, turned off, etc. During the period of time glue is to be applied. In this way a glue "stitch" is created. The stitch period is determined by dividing the program counter value by a suitable divisor, such as the number four. If four is chosen the program counter is readily divided by four simply by "reading" the third LSB bit of the program counter, which shifts between zero and one at a divide-by-four rate. If the stitch is in the "off" state, the run subroutine cycles to the turn-off top and bottom glue step described below.

If the stitch mode is in the "on" state, a test is made to determine whether or not the operation of the top glue head is to be inhibited. If the operation of the top glue head is inhibited (as determined by the operator during the programming steps described above), the run subroutine cycles to a bottom glue head inhibit test described below. If the top glue head is not to be inhibited, the top glue head is turned on. After the top glue head turn-on command has occurred, a test is made to determine whether the bottom glue head is to be inhibited. If the bottom glue head is not to emit glue the run subroutine cycles to a case in PHASE 1 test described below. If the bottom glue head is to emit glue, i.e., its operation is not inhibited, the bottom glue head is turned on. After the bottom glue head turn on command has occurred, or after the top and bottom glue heads have been commanded off as a result of the turn off top and bottom glue step occurring as a result of following one of the numerous paths previously described, the case is in PHASE 1 test is made.

The case in PHASE 1 test is a test to determine whether the PHASE 1 flag is set or reset. If the PHASE 1 flag is in a clear state, the glue prime pump is turned on. If the PHASE 1 flag is set, a test is made to determine whether the case is in the glue prime on range. If the case is in the glue prime on range, as determined by the program counter value, the glue prime pump is turned on. If the case is not in the glue prime on range, the glue prime pump is turned off.

After the glue prime pump has been turned on or off, as required, a test is made to determine whether or not the flight bar overload flag has been set. If the overload flag has been set, a pass through the timing subroutine illustrated in FIG. 11 and previously described is made. After the timing subroutine pass has been completed, the run subroutine cycles to the flight bar synchronization step illustrated in FIG. 10A and previously described and another pass through the run subroutine is made.

If the overload flag has not been set, T-deck and kicker data are read from memory and a test is made to determine whether the T-deck and kicker are to be programmed off at the case position defined by the program counter value existing when this test is performed. If the T-deck and kicker are programmed off, the run subroutine cycles to a kicker program off test described below. If either the T-deck or the kicker are programmed on, a test is made to determine if the PHASE 2 flag is set. If the PHASE 2 flag is not set, the run subroutine cycles to a PHASE 1 flag test described below. If the PHASE 2 flag is set, a test is made to determine whether the kicker has been programmed on at the case position determined by the program counter value. If the kicker is programmed on, the kicker is commanded on (or commanded to remain on).

After the kicker turn-on command has occurred, or if the kicker has not been programmed on, the run program cycles to the PHASE 1 flag test. If the PHASE 1 flag is set, denoting that a case is present in the PHASE 1 portion of the case path of travel through the programmable case sealing machine, a test is made to determine whether the T-deck is programmed on. If the T-deck is programmed on at the position of the case determined by the program counter value, the T-deck is commanded on (or commanded to remain on). If the PHASE 1 flag has not been set or the T-deck has not been programmed on, or after the T-deck turn-on command has occurred, the kicker programmed-off test is made. If the kicker has been programmed off at the case position determined by the program counter value, the kicker is commanded off. If the kicker has not been programmed off, or after the kicker has been commanded off, a test is made to determine whether or not the T-deck has been programmed off at the case position determined by the program counter value. If the T-deck has been programmed off, the T-deck is commanded off. After the T-deck has been commanded off, or if the T-deck has not been programmed off, a pass through the time subroutine (FIG. 11) is made. After the pass through the timing subroutine, the run program cycles to the flight bar sync test, illustrared in FIG. 10A and previously described.

As will be appreciated from the foregoing description, when the programmable case sealing machine is in a run status, passes are continuously made through the run subroutine. During each pass, tests are made to determine whether or not certain actions should take place at the position of the box as determined by the program counter value at the time the test is made. During each pass, which includes a pass through the timing subroutine, the program counter is incremented as the flight bars move forward or decremented if the flight bars move in reverse. In addition, a PHASE 1 flag is set when a case enters a PHASE 1 or in-feed portion of the overall case path of travel and a PHASE 2 flag is set when the case leaves the in-feed portion and enters a glue portion of the case path of travel. As will be readily appreciated, a case can be in either position or cases can be in both positions. Flight bar movement can be stopped for a predetermined period of time in order to avoid jamming and other operational problems when abnormally long cartons are being sealed. Depending upon programming, both the top and the bottom of a case can be simultaneously sealed, or only the top or only the bottom can be sealed, as desired. That is, the programmable case sealing machine can be programmed to seal only the bottom flaps, only the top flaps, or both the bottom and top flaps during the pass of a case through the programmable case sealing machine. If the bottom is to be glued, the T-deck is programmed to cause the bottom major flaps to drop away from the bottom minor flaps and glue to be applied to the bottom major and minor flaps. If the top is to be sealed, the kicker is actuated as is the top glue head. Both the top and bottom glue heads can be operated in a stitch mode or a non-stitch mode, as desired.

While a preferred embodiment of the invention has been illustrated and described, it will be appreciated that various changes can be made therein without departing from the spirit and scope of the invention. For example, if the glue to be used is a hot melt glue, the operation of the run subroutine of the programmable case sealing machine can be inhibited whenever the temperature of the glue is below a desired value. Consequently, the invention can be practiced otherwise than as specifically described herein.

The embodiments of the invention in which an exclusive property or privilege is claimed are defined as follows:

1. A programmable case sealing machine comprising:

(A) conveyor means for moving cases to be sealed along a path of travel;

(B) case sealing means located along said path of travel for selectively sealing the top and bottom of cases moved by said conveyor means;

(C) gate means located at the infeed end of said conveyor means for controlling the receipt of cases by said conveyor means;

(D) conveyor sensing means for sensing the position of said conveyor means and, thus, the position of cases moved by said conveyor means;

(E) case infeed sensing means for sensing the presence of a case on the infeed side of said gate means;

(F) programming means for producing programming information for controlling the operation of said case sealing means; and, (G) a central processing unit coupled to:

(1) said conveyor means for receiving said information about the position of said conveyor means;

(2) said case infeed sensing means for receiving information about the presence of a case at the infeed end of said gate means;

(3) said programming means for receiving and storing said programming information; and, (4) said gate means and said case sealing means for:

(a) actuating said gate means to allow a case to be received by said conveyor means when said conveyor means is in a predetermined position; and, (b) controlling said case sealing means so that the top and bottom of cases moved by said conveyor means passed said case sealing means are selectively sealed in accordance with the programming information received by said center processing unit from said programming means.

2. A programmable case sealing machine as claimed in claim 1 wherein:

said conveyor means includes a chain-driven flight bar mechanism for pushing cases along said path of travel; and, said conveyor sensing means includes pulse producing means connected to said chain-driven flight bar mechanism for producing pulse information as said chain-driven flight bar mechanism pushes said cases, said pulse information defining the direction and distance of movement of said cases.

3. A programmable case sealing machine as claimed in claim 2 wherein said conveyor sensing means also includes a synchronizing switch located along the path of travel of said chain-driven flight bar mechanism and actuated to produce a synchronizing signal when said chain-driven flight bar mechanism is in a predetermined position.

4. A programmable case sealing machine as claimed in claim 3 wherein said central processing unit includes a program counter that is actuated by the pulses produced by said pulse producing means.

5. A programmable case sealing machine as claimed in claim 4 wherein said program counter is reset by said synchronizing signal produced when said synchronizing switch is actuated by said chain-driven flight bar mechanism being in said predetermined position.

6. A programmable case sealing machine as claimed in claim 5 including a chain position encoder coupled to said chain-driven flight bar mechanism, said chain-driven encoder producing said pulse signals defining the direction and distance of movement of said cases.

7. A programmable case sealing machine as claimed in claim 3 wherein said programming means actuates said gate means to allow a case to be received by said chain-driven flight bar mechanism upon receipt of said synchronizing signal, provided said case infeed sensing means senses the presence of a case on the infeed side of said gate means when said synchronizing signal occurs.

8. A programmable case sealing machine as claimed in claim 7 wherein said central processing unit includes a program counter that is actuated by the pulses produced by said pulse producing means.

9. A programmable case sealing machine as claimed in claim 8 wherein said program counter is reset by said synchronizing signal produced when said synchronizing switch is actuated by said chain-driven flight bar mechanism being in said predetermined position.

10. A programmable case sealing machine as claimed in claim 9 including a chain position encoder coupled to said chain-driven flight bar mechanism, said chain-driven encoder producing said pulse signals defining the direction and distance of movement of said cases.

11. A programmable case sealing machine as claimed in claim 7 wherein said case sealing means includes top and bottom glue heads coupled to said central processing unit, said central processing unit selectively enabling said top and bottom glue heads, depending upon the programming information produced by said programming means and stored by said central processing unit, after the number of pulses counted by said program counter reaches a predetermined level.

12. A programmable case sealing machine as claimed in claim 11 wherein said case sealing machine includes an actuatable kicker located above the path of travel of cases through said case sealing machine and between said top glue head and said gate means, said actuatable kicker coupled to said central processing unit for being selectively actuated by said central processing unit in accordance with the programming information produced by said programming means and stored by said central processing unit, after the number of pulses counted by said program counter reaches a predetermined level.

13. A programmable case sealing machine as claimed in claim 11 including an actuatable T-deck located beneath the path of travel of cases through said case sealing machine and between said bottom glue head and said gate means, said T-deck adapted to allow the bottom major flaps to fall away from the bottom minor flaps of a case moving through said case sealing machine when said T-deck is actuated, said actuatable T-deck coupled to said central processing unit for being selectively actuated by said central processing unit in accordance with the programming information produced by said programming means and stored by said central processing unit, after the number of pulses counted by said program counter reaches a predetermined level.

14. A progammable case sealing machine as claimed in claim 13 wherein said case sealing machine includes an actuatable kicker located above the path of travel of cases through said case sealing machine and between said top glue head and said gate means, said actuatable kicker coupled to said central processing unit for being selectively actuated by said central processing unit in accordance with the programming information produced by said programming means and stored by said central processing unit, after the number of pulses counted by said program counter reaches a predetermined level.

15. A programmable case sealing machine as claimed in claim 14 wherein said programming means includes a plurality of programming switches.

16. A programmable case sealing machine as claimed in claim 15 wherein said programming means also includes a key actuated run-program switch movable between a program position and a run position.

17. A programmable case sealing machine as claimed in claim 16 wherein said programming means also includes an alphanumeric display.

18. A programmable case sealing machine as claimed in claim 17 wherein said central processing unit includes a program counter that is incremented and decremented by signals produced by said programming means when said key actuated run-program switch is in said program position.

19. A programmable case sealing machine as claimed in claim 18 wherein said program counter is incremented and decremented by the pulses produced by said pulse producing means when said key actuated run-program switch is in said run position.

20. A programmable case sealing machine as claimed in claim 19 wherein said program counter is reset by the synchronizing signal produced when said synchronizing switch is actuated by said chain-driven flight bar mechanism being in said predetermined position.

21. A progammable case sealing machine as claimed in claim 20 including a chain position encoder coupled to said chain-driven flight bar mechanism, said chain-driven encoder producing said pulse signals defining the direction and distance of movement of said cases.

22. A programmable case sealing machine as claimed in claim 4 wherein said case sealing means includes top and bottom glue heads coupled to said central processing unit, said central processing unit selectively enabling one or both of said top and bottom glue heads, depending upon the programming information produced by said programming means and stored by said central processing unit, after the number of pulses counted by said program counter reaches a predetermined level.

23. A programmable case sealing machine as claimed in claim 4 including a T-deck located beneath the path of travel of cases through said case sealing machine and between said bottom glue head and said gate means, said T-deck adapted to allow the bottom major flaps to fall away from the bottom minor flaps of a case moving through said case sealing machine when said T-deck is actuated, said T-deck coupled to said central processing unit for being actuated by said central processing unit in accordance with the programming information produced by said programming means and stored by said central processing unit, after the number of pulses counted by said program counter reaches a predetermined level.

24. A programmable case sealing machine as claimed in claim 4 wherein said case sealing machine includes a kicker located above the path of travel of cases through said case sealing machine and between said top glue head and said gate means, said kicker coupled to said central processing unit for being actuated by said central processing unit in accordance with the programming information produced by said programming means and stored by said central processing unit, after the number of pulses counted by said program counter reaches a predetermined level.

* * * * *